US007278908B2

(12) United States Patent
Urban et al.

(10) Patent No.: US 7,278,908 B2
(45) Date of Patent: Oct. 9, 2007

(54) POLISHING DISK FOR A TOOL FOR THE FINE MACHINING OF OPTICALLY ACTIVE SURFACES ON SPECTACLE LENSES IN PARTICULAR

(75) Inventors: Lothar Urban, Solms (DE); Peter Philipps, Mengerskirchen/Dillhausen (DE)

(73) Assignee: Satisloh GmbH, Wetzlar (DE)

( * ) Notice: Subject to any disclaimer, the term of this patent is extended or adjusted under 35 U.S.C. 154(b) by 0 days.

(21) Appl. No.: 11/367,605

(22) Filed: Mar. 3, 2006

(65) Prior Publication Data

US 2006/0199481 A1 Sep. 7, 2006

(30) Foreign Application Priority Data

Mar. 4, 2005 (DE) ..... 10 2005 010 583

(51) Int. Cl.
*B24B 29/00* (2006.01)

(52) U.S. Cl. ..... 451/285; 451/259; 451/290; 451/495; 451/921

(58) Field of Classification Search ..... 451/42, 451/277, 259, 495, 508, 511, 921, 285, 290
See application file for complete search history.

(56) References Cited

U.S. PATENT DOCUMENTS

| | | | | |
|---|---|---|---|---|
| 3,583,111 | A * | 6/1971 | Volk | 451/490 |
| 3,916,574 | A * | 11/1975 | Prunier | 451/277 |
| 4,010,583 | A * | 3/1977 | Highberg | 451/42 |
| 5,095,660 | A * | 3/1992 | Dillon | 451/163 |
| 5,287,662 | A | 2/1994 | Weis et al. | |
| 5,695,393 | A * | 12/1997 | Granziera | 451/390 |
| 6,126,520 | A * | 10/2000 | Jochim-Schmidt et al. | 451/42 |
| 6,371,837 | B1 * | 4/2002 | Luedeke | 451/57 |
| 6,814,650 | B2 | 11/2004 | Bernard et al. | |
| 2004/0023610 | A1 * | 2/2004 | Hu et al. | 451/526 |
| 2004/0224619 | A1 * | 11/2004 | Granziera et al. | 451/277 |
| 2006/0009126 | A1 | 1/2006 | Kuebler et al. | |
| 2006/0073770 | A1 * | 4/2006 | Toyoshima et al. | 451/41 |
| 2006/0099889 | A1 * | 5/2006 | Tabata et al. | 451/41 |

FOREIGN PATENT DOCUMENTS

| | | |
|---|---|---|
| DE | 1 239 211 | 4/1967 |
| DE | 102 48 104 A1 | 5/2003 |
| JP | 63232957 | 9/1988 |
| JP | 01027846 | 1/1989 |
| JP | 04171168 A | 6/1992 |
| JP | 2003145401 | 5/2003 |

* cited by examiner

*Primary Examiner*—Eileen P. Morgan
(74) *Attorney, Agent, or Firm*—Reising, Ethington, Barnes, Kisselle, P.C.

(57) ABSTRACT

A polishing disk for a tool for the fine machining of optically active surfaces on spectacle lenses in particular is disclosed, which comprises a support body, to which a foam layer is attached, wherein a polishing film bears against the foam layer. The polishing film is provided with at least one opening in a central region. During machining, the opening ensures pressure equalization and makes liquid polishing agent available from inside the foam layer, as a result of which better rinsing and cooling of otherwise disadvantaged regions of the polishing disk is achieved. As a result, a polishing disk of simple and cost-effective design is proposed, which is much more durable than the prior art while achieving high surface qualities.

13 Claims, 3 Drawing Sheets

POLISHING DISK FOR A TOOL FOR THE FINE MACHINING OF OPTICALLY ACTIVE SURFACES ON SPECTACLE LENSES IN PARTICULAR

TECHNICAL FIELD

The present invention relates to a polishing disk for a tool for the fine machining of optically active surfaces. Such polishing disks are used in bulk in the manufacture of prescription spectacle lenses in particular.

When the term "spectacle lenses" is used below by way of example of workpieces with optically active surfaces, this is intended to refer not only to spectacle lenses made of mineral glass but also to spectacle lenses made of all other customary materials, such as polycarbonate, CR 39, Hi Index, etc., that is to say also plastic.

PRIOR ART

The machining of the optically active surfaces of spectacle lenses can roughly be split into two machining phases, namely firstly the premachining of the optically active surface to produce the prescription macro-geometry and then the fine machining of the optically active surface to eliminate any traces left behind by the premachining and obtain the desired micro-geometry. While the premachining of the optically active surfaces of spectacle lenses is effected by grinding, cutting and/or turning, depending inter alia on the material of the spectacle lenses, during fine machining the optically active surfaces of spectacle lenses are usually subjected to a fine grinding, lapping and/or polishing operation.

For this fine machining operation, the prior art (e.g. EP 1 249 307 A2, DE 102 48 104 A1, DE 102 50 856 A1, DE 103 19 945 A1) makes use of polishing disks which have at least a three-layer structure, with (1.) a relatively solid or rigid support body which faces towards the tool spindle, with (2.) a foam layer attached to said support body and (3.) a grinding or polishing film as the active machining part of the tool, the film bearing against the foam layer and facing towards the workpiece. On account of the elastic deformability of the foam layer, the polishing film can adapt within certain limits to the geometry of the surface to be machined, both in "static" terms, that is to say from spectacle lens to spectacle lens, and in "dynamic" terms, that is to say during the machining of a given spectacle lens, in which a relative movement takes place between the polishing disk and the spectacle lens. The elasticity of the foam layer also has a considerable influence on the material removal behaviour of the polishing disk during the polishing process.

One essential prerequisite for a trouble-free polishing process and long-lasting tools and for obtaining high-quality machining results is a good supply of liquid polishing agent during the machining operation. The polishing agent comprises abrasive constituents which have to be transported by means of the liquid to the point of engagement between tool and workpiece, and furthermore serves for cooling and rinsing at the point of engagement between tool and workpiece. In the prior art, the polishing agent is supplied radially from outside via flexibly adjustable tubes, the outlet openings of which are positioned as close as possible to the working gap between the polishing film and the surface of the spectacle lens which is to be machined.

When using the above-described adaptable polishing disk, it has been found that, with polishing agent being supplied in the conventional manner, this results in relatively poor wetting of the polishing film with the liquid polishing agent, particularly in regions of the polishing film which, during machining, for kinematic reasons, do not leave the surface of the spectacle lens that is to be machined. In those regions of the polishing disk, this may lead to the active polishing surface structures of the polishing film not being sufficiently rinsed and to the high level of heat caused by friction being dissipated only to an insufficient extent. As a result, these regions of the polishing disk may dry out and thus the polishing film may undesirably solidify, which leads to a poorer surface quality being obtained on the machined surface and thus makes it necessary to replace the polishing disk.

Based on the prior art, as represented for example by DE 102 50 856 A1, the object of the invention is to provide a simply designed polishing disk for a tool for the fine machining of optically active surfaces on spectacle lenses in particular, which can be used for as long as possible while achieving high surface qualities.

SUMMARY OF THE INVENTION

According to the invention there is provided a polishing disk for a tool for the fine machining of optically active surfaces on lenses, the polishing disk comprising a support body, to which a foam layer is attached, wherein a polishing film bears against said foam layer, and wherein the polishing film is provided with at least one opening in a central region.

The opening according to the invention in the polishing film ensures a fluid connection between an inner region of the foam layer, which is saturated with polishing agent in the manner of a sponge during the machining operation, and the outer surface of the polishing film which is in machining engagement with the surface of the workpiece that is to be machined. The liquid polishing agent can thus circulate better and can also pass from the interior of the polishing disk to the engagement regions between the polishing film and the surface of the workpiece that is to be machined, as a result of which better rinsing and cooling is ensured at these engagement regions on account of increased wetting of the polishing film and a more uniform film of polishing agent. Accordingly, there is no longer any partial solidification of the polishing film which is detrimental to the surface quality obtained, so that the polishing disk can be used for a longer period compared to the above prior art.

Moreover, the opening according to the invention also performs a kind of valve function: In order to polish while keeping its shape as much as possible, the active polishing surface of the polishing disk and hence the polishing film must have a relatively high flexibility. However, on account of this flexibility, particularly when the polishing disk goes beyond the edge of the spectacle lens that is to be machined, but also in the machining of toric surfaces for example, the polishing film is deformed to a relatively large extent during the turning of tool and workpiece. As a consequence of this deformation of the polishing film, the foam layer lying therebelow which is saturated with the liquid polishing agent undergoes a flexing movement; a pumping effect is produced between various regions of the foam layer covered from above and below.

If, in the prior art, the liquid polishing agent could not exit rapidly enough from the sides of an edge region of the foam layer, build-ups of pressure were obtained particularly in inner regions of the foam layer. In the prior art, it was possible for these pressure build-ups to cause the pores of the foam layer to partially tear or to cause the foam layer to tear at least partially away from the respective opposing surface at its points of connection to the support body and/or to the polishing film, so that the polishing disk had to be replaced.

With the opening according to the invention in the polishing film, faster pressure equalization is possible here and dangerous build-ups of high pressure no longer occur particularly in the inner regions of the foam layer, so that, even there, the foam layer no longer tears and no longer detaches from the opposing surfaces on the support body and/or polishing film.

The described internal circulation/ventilation on the polishing disk according to the invention which is brought about by the opening in the polishing film furthermore leads to an improved exchange of liquid polishing agent in the foam layer, which is associated with an advantageous "internal cooling" of the polishing disk.

As a result, a polishing disk of simple and cost-effective design is proposed, which is much more durable than the prior art while achieving high surface qualities, as a result of which it is predestined in particular for the industrial manufacture of prescription spectacle lenses.

Various geometries are conceivable for the at least one opening in the polishing film. For example, the opening may be designed to be cross-shaped, star-shaped, curved or S-shaped, elliptical or the like. It is also possible for a number of openings to be provided, these being shaped and distributed for example like the attachment holes on a button. However, it is preferred if the at least one opening in the polishing film is round and hence has a simple geometry that is easy to produce.

Studies by the Applicant have shown that a particularly good circulation and ventilation of the liquid polishing agent is obtained by means of the at least one opening in the polishing film, and specifically without the opening significantly reducing the size of the active polishing surface of the polishing film if the at least one opening in the polishing film covers a surface area of 0.25 to 2% of the overall front face of the polishing film.

It is furthermore preferred if a cutout in the foam layer adjoins the at least one opening in the polishing film in the direction of the support body. This cutout can advantageously serve as a reservoir for the liquid polishing agent. However, it is also conceivable that no cutout is provided here; rather, the foam layer ends directly and with open pores at the at least one opening in the polishing film.

If a cutout is provided in the foam layer, the cutout may extend up to the support body. Such a continuous cutout is not only particularly simple to produce but also advantageously maximizes the holding volume of the reservoir for the liquid polishing agent, the reservoir being formed by the cutout.

Moreover, the polishing film may protrude inwards beyond an outer periphery of the cutout in the foam layer. On account of the lack of support provided to the polishing film by the foam layer at the protruding region of the polishing film, it is easier for the polishing film to yield in the direction of the support body; a rounding or a natural radius occurs on the polishing film at that point. As a result, undesirable impressions are avoided on the surface machined by the polishing disk, which impressions could otherwise be caused by a more or less sharp edge of the polishing film which arises if the at least one opening in the polishing film is produced by cutting-out or punching.

The polishing film may also protrude outwards beyond an outer periphery of the foam layer. Since the polishing film is deliberately made larger in its radial dimensions than the foam layer located therebelow, that is to say has a certain overhang with respect to the foam layer, the polishing film spreads away slightly in this region from the surface that is to be machined. As a result, on the one hand undesirable impressions are avoided, as already described above; beyond the outer edge of the polishing film, it is no longer possible for any significant polishing pressure to be exerted on the surface to be machined. On the other hand, the overhang of the polishing film with respect to the foam layer also leads to a further improvement in the supply of polishing agent: Between the surface of the spectacle lens which has just been machined and the overhanging part of the polishing film which is slightly folded away therefrom, a capillary gap which opens radially outwards is formed, which always entrains a certain amount of polishing agent even at high rotary speeds. The additional polishing agent reservoir thus created is not spun off but rather is carried along with each movement and is thus constantly available.

Furthermore, the support body may be provided with a depression for orienting the foam layer, which simplifies in particular the attachment of the foam layer to the support body. On the one hand, the edge delimiting this depression clearly defines the site of attachment for the foam layer, and thus also serves as an aid for applying an adhesive for attaching the foam layer to the support body. On the other hand, the edge delimiting the depression also ensures a certain form-fitting hold of the foam layer on the support body.

With regard to an active polishing surface of the polishing film that is as large as possible and is present even at low polishing pressures, an embodiment of the polishing disk is also preferred in which the support body has a support surface for the attachment of the foam layer, wherein the support surface is preshaped in accordance with the macro-geometry of the surface to be machined, e.g. is preshaped in a correspondingly toric manner in the case of machining a toric surface.

In order to improve the ability of the polishing disk to adapt to the macro-geometry of the surface to be machined, via the elasticity of the foam layer, the support body may furthermore be made of a rubber-elastic material with a Shore A hardness in the range of preferably 60 to 80.

The polishing disk according to the invention can advantageously be used on a tool for the fine machining of optically active surfaces on spectacle lenses in particular, comprising a base body which can be fitted on a tool spindle of a machining machine, an articulated part which has a receiving section guided such that it can be tilted and moved longitudinally with respect to the base body, said receiving section being adjoined in the direction of the base body by a bellows section, by means of which the articulated part is fixed to the base body such that it can rotate therewith, and a pressure medium chamber which is delimited by the base body and the articulated part and which can optionally be acted upon by a pressure medium, wherein the polishing disk is held on the receiving section of the articulated part in a replaceable manner.

In order to ensure that the polishing disk is securely held on and rotated with the receiving section of the articulated part, while making it simple for the polishing disk to be replaced, structures of complementary shape may be formed on the facing surfaces of the receiving section and the support body of the polishing disk, which structures engage in one another in a form-fitting manner. In this case, the structures of complementary shape may be formed by a protrusion on the support body of the polishing disk and an associated cutout in the receiving section of the articulated part. However, particularly with regard to simple handling of the polishing disk, it is preferred if the structures of complementary shape are formed by a protrusion on the receiving section and an associated cutout in the support body.

Finally, in one embodiment which is particularly simple in terms of manufacturing technology, the protrusion on the receiving section and the cutout in the support body may have the shape of a truncated pyramid which has a rectangular, non-square base with a pair of long sides and a pair of short sides. With regard to good tilting stability of the polishing disk during the machining operation, it is preferred here, in the case of a polishing disk in which the support surface of the support body is preshaped in a toric manner, with a base axis and a cylinder axis, if the truncated pyramid-shaped cutout in the support body is oriented with respect to the support surface in such a way that the pair of long sides run parallel to the base axis.

BRIEF DESCRIPTION OF THE DRAWINGS

The invention will be explained in more detail below on the basis of preferred examples of embodiments and with reference to the appended drawings, wherein identical or corresponding parts are provided with the same references. In the drawings.

DETAILED DESCRIPTION OF THE EXAMPLES OF EMBODIMENTS

Figure 1:
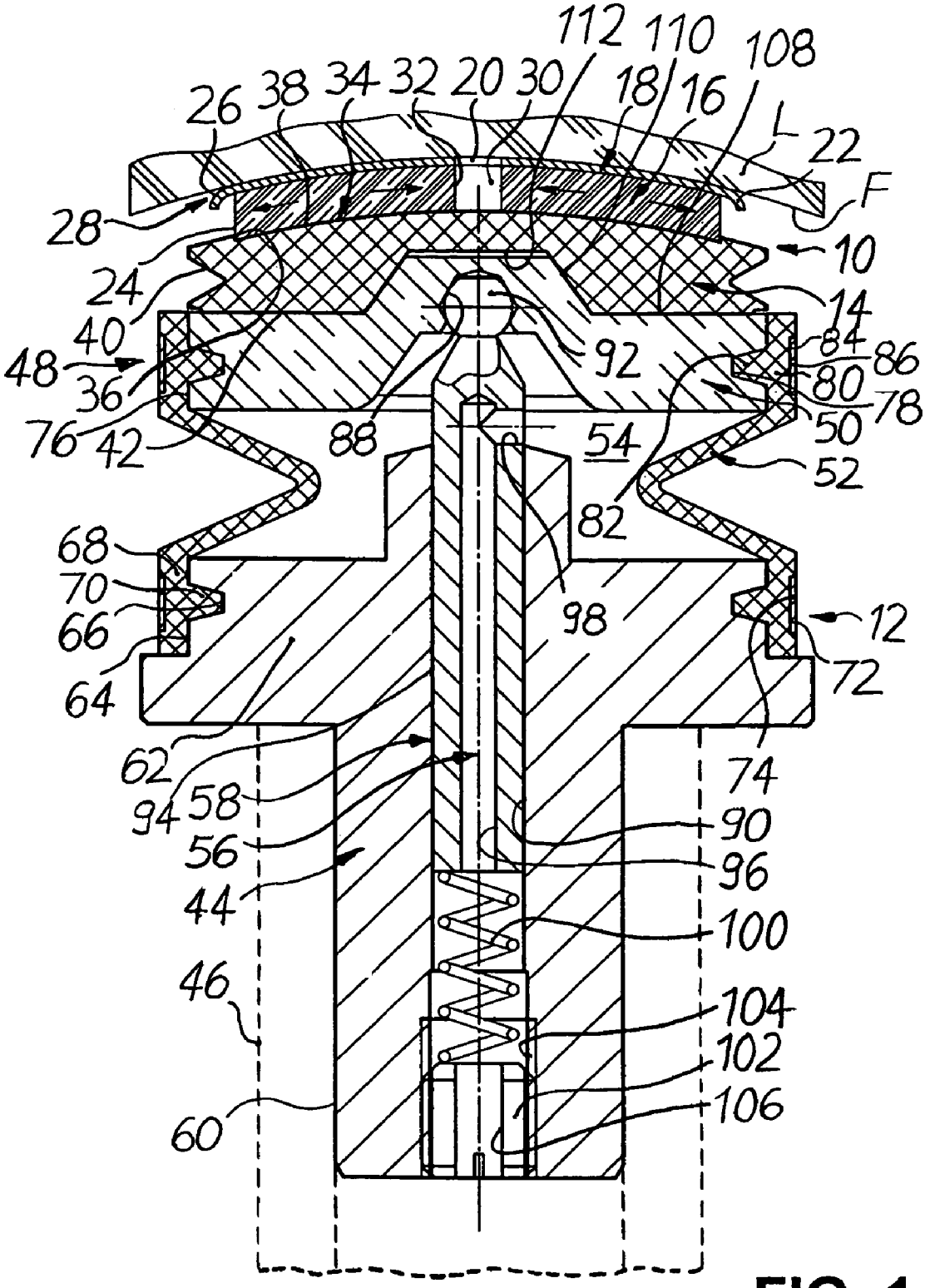
FIG. 1 shows, on an enlarged scale compared to reality, a broken-off view in longitudinal section of a tool for the fine machining of optically active surfaces on spectacle lenses, on which a polishing disk according to a first example of embodiment of the invention is releasably held, said polishing disk being in machining engagement with a surface to be machined.

As shown in FIG. 1, a polishing disk 10 for a tool 12 for the fine machining of optically active surfaces F on spectacle lenses L in particular comprises a support body 14, to which a foam layer 16 is attached, wherein a polishing film 18 bears against said foam layer. It is essential that the polishing film 18 is provided with at least one opening 20 in a central region, as will be described in more detail below.

The polishing film 18, also referred to as a "polishing pad", which forms the active machining part of the tool as shown in FIG. 1, is a commercially available, elastic and wear-resistant fine grinding or polishing agent support, such as for example a PUR (polyurethane) film which has a thickness of 0.5 to 1.4 mm and a Shore D hardness of between 12 and 45. The polishing film 18 is designed to be slightly thicker if prepolishing is to be carried out using the polishing disk 10, and on the other hand is designed to be slightly thinner in the case of fine polishing.

Figure 2:
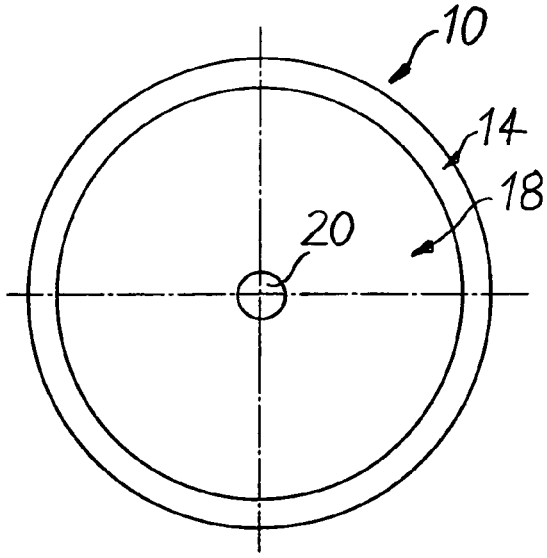
FIG. 2 shows, on a somewhat reduced scale compared to the diagram in FIG. 1, a plan view of the polishing disk of FIG. 1 which has been removed from the tool, seen from above in FIG. 1.

The radial dimensions of the polishing film 18 are preferably selected in such a way that the polishing film 18, which is circular in this example of embodiment as seen in the plan view of FIG. 2, protrudes outwards with an outer edge region 22 beyond an outer periphery 24 of the foam layer 16, which in this case is cylindrical (see FIG. 1). The outer diameter of the polishing film 18 may for example be dimensioned such that the outer diameter of the foam layer 16 is approximately 85 to 95% of the outer diameter of the polishing film 18. The fact that the flexible polishing film 18 protrudes beyond the supporting foam layer 16 results in a natural radius or an "edge rounding", which is shown at 26 in FIG. 1 and, by preventing a sharp edge, ensures a clean surface structure and thus a high cosmetic quality of the machined surface F. Moreover, during the machining, a wedge-shaped gap 28 is produced at the outer edge region 22 of the polishing film 18 between the machined surface F and the polishing film 18, which gap always entrains a certain amount of liquid polishing agent as a result of its capillary action and accordingly also serves as an annular polishing agent reservoir.

Figure 3:
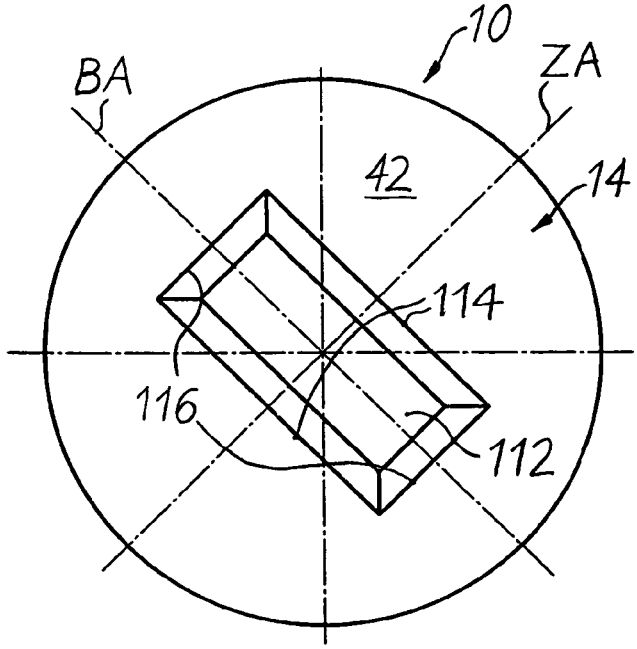
FIG. 3 shows, on the scale of FIG. 1, a view from below of the polishing disk of FIG. 1 which has been removed from the tool, seen from below in FIG. 1.

The through-opening 20 is produced at a central point of the polishing film 18 by cutting or punching, said opening having a circular shape in the example of embodiment shown in FIGS. 1 to 3. Preferably, the opening 20 in the polishing film 18 covers a surface area of 0.25 to 2% of the overall front face of the polishing film 18 which faces towards the surface F to be machined.

In the illustrated example of embodiment, the polishing film 18 is attached to the foam layer 16 by means of a suitable adhesive. However, the polishing film 18 can also be connected to the foam layer 16 in a more or less long-lasting manner in other ways, for example by being vulcanized on or applied by material such as Velcro™. In any case, the connection between the polishing film 18 and the foam layer 16 must be secure enough that the polishing film 18 is moved, in particular rotated, along with the foam layer 16 at all times during the machining operation.

The foam layer 16 may be for example an open-cell PUR (polyurethane) foam, as can be obtained for example under the trade name Sylomer® R from Getzner Werkstoffe GmbH, Berlin, Germany. This has a Shore A hardness of approximately 60. The upper side of the foam layer 16 which faces towards the polishing film 18 can be, but does not have to be, provided with a final "casting skin" (separating layer for the casting mould; not shown) which gives the foam layer 16 additional stiffness. The thickness of the foam layer 16 may be for example between 2 and 10 mm, depending on the respective machining requirements. It is obvious to the person skilled in the art that the size and distribution of the pores in the foam layer 16 must be selected in such a way that the above-discussed desired rinsing and cooling by means of the liquid polishing agent is ensured via the opening 20 in the polishing film 18.

In the example of embodiment shown in FIG. 1, a cutout 30 in the foam layer 16 adjoins the opening 20 in the polishing film 18 in the direction of the support body 14, said cutout extending up to the support body 14. The cutout 30, which is preferably formed by punching, has a cylindrical outer peripheral face 32, the diameter of which corresponds to the diameter of the opening 20 in the polishing film 18. The cutout 30 also serves as a reservoir for the liquid polishing agent during the machining operation.

The foam layer 16 is in turn securely attached for example by means of a suitable adhesive to the support body 14, which is preferably made of a rubber-elastic material such as NBR (elastomer based on acrylonitrile-butadiene-styrene rubber), EPDM (elastomer based on ethylene-propylene-diene rubber) or a PUR (polyurethane) elastomer, with a Shore A hardness in a range of 60 to 80. In the example of embodiment shown in FIG. 1, the support body 14 is provided with a depression 34, the edge 36 of which serves for the orientation of the foam layer 16. The bottom of the depression 34 forms the actual support surface 38, to which the foam layer 16 is attached. In the example of embodiment shown in FIG. 1, the support surface 38 is preshaped in accordance with the macro-geometry of the surface F to be machined, here a toric surface.

On its outer periphery, the support body 14 has an annular groove 40 which is V-shaped in cross section and serves as a handle for a gripper (not shown) of an automatic polishing disk replacement device (also not shown). At a flat underside 42 of the support body 14, the polishing disk 10 is held on the tool 12 in a replaceable manner to be described below.

As shown in FIG. 1, the tool 12 has a base body 44 which can be fitted on a tool spindle 46 (shown in dashed line in FIG. 1) of a machining machine (not shown). The tool 12 furthermore has an articulated part (shown as a whole at 48) which has a receiving section 50 guided such that it can be tilted and moved longitudinally with respect to the base body 44, on which receiving section the polishing disk 10 is held in a replaceable manner. The receiving section 50 is adjoined in the direction of the base body 44 by a bellows section 52, by means of which the articulated part 48 is fixed to the base body 44 such that it can rotate therewith. The base body 44 and the articulated part 48 delimit a pressure medium chamber 54 which can optionally be acted upon by a suitable liquid or gaseous pressure medium (e.g. oil or compressed air) via a channel 56, in order to apply a machining pressure during machining of the optically active surface F via the receiving section 50 and the polishing disk 10 lying thereon. A guide member 58, which is actively connected to the receiving section 50 of the articulated part 48, is guided in a longitudinally displaceable manner on the base body 44 so that the receiving section 50 can be moved in the longitudinal direction of the guide member 58 and held in the transverse direction with respect to the guide member 58, but can be tilted with respect to the guide member 58 under elastic deformation of the bellows section 52 of the articulated part 48.

The base body 44, which is preferably made of metal, comprises a fixing section 60, by means of which the tool 12 can be releasably mounted on the tool spindle 46, and a head section 62 which adjoins the fixing section 60 and to which the articulated part 48 is attached in a replaceable manner by means of the bellows section 52. In the illustrated example of embodiment, the fixing section 60 has, in a very simple configuration, a cylindrical outer peripheral surface. For automatic tool change, however, the fixing section may also be designed as a steep-angle tapered section with, for example, a hollow taper shank according to German standard DIN 69893. Depending on the respecting handling requirements, it is also conceivable to design the fixing section as a block section, as is customary in the manufacture of prescription spectacles lenses L and as standardized in German standard DIN 58766. This section may optionally also be provided with a gripping groove for any handling systems.

The head section 62 of the base body 44 has a cylindrical recess 64 which is provided with a radial groove 66 for the form-fitting attachment of the bellows section 52 of the articulated part 48 on the base body 44. In this case, the bellows section 52 of the articulated part 48 has an essentially hollow-cylindrical fixing end section 68 which is provided on its inner circumference with a peripheral lug 70 which protrudes radially inwards and engages in a form-fitting manner in the radial groove 66 of the recess 64 on the head section 62. On its outer circumference, the fixing end section 68 is in turn provided with a radial groove 72 which serves to receive in a form-fitting manner a metal annular clip 74 which is known per se. The annular clip 74 clamps the fixing end section 68 against the recess 64. As a result, the articulated part 48 is fixed to the base body 44 by means of the bellows section 52 in the pushing and pulling direction in a form-fitting manner and by friction in the circumferential direction, and hence in a manner so as to rotate with said base body.

The receiving section 50 of the articulated part 48 is fixed to the bellows section 52 in the pushing and pulling direction in a form-fitting manner and by friction in the circumferential direction in an analogous manner. In this case, the essentially disk-shaped receiving section 50 has on a cylindrical outer peripheral face 76 a radial groove 78 in which a lug 82 engages in a form fitting manner, said lug protruding radially inwards and being attached to the inner circumference of a hollow-cylindrical fixing end section 80 of the bellows section 52. The fixing end section 80 is also provided on its outer circumference with a radial groove 84 for receiving an annular clip 86 which clamps the fixing end section 80 to the receiving section 50.

The receiving section 50 of the articulated part 48, which in the illustrated example of embodiment is made of a plastic, is circular when seen in a plan view from above in FIG. 1 and has an undercut receiving chamber 88 essentially in the centre of its inner side facing towards the pressure medium chamber 54, said receiving chamber being designed for the articulated attachment of the receiving section 50 to the guide member 58. The latter is formed by a pin which is guided rotatably and in a longitudinally displaceable manner in a central receiving bore 90 in the base body 44, said bore extending through the entire base body 44 in the longitudinal direction. At its end facing towards the receiving section 50 of the articulated part 48, the guide member 58 has a spherical head 92 which is joined via a conical transition section to a cylindrical main part 94 of the guide member 58 which is guided in the receiving bore 90. The spherical head 92 of the guide member 58 is connected into the undercut receiving chamber 88 of the receiving section 50 in the manner of a ball joint, so that the receiving section 50 can pivot with respect to the guide member 58 and makes it possible for cardanic compensation movements to be carried out.

As can also be seen from FIG. 1, the channel 56 for pressurizing the pressure medium chamber 54 is formed in the guide member 58, wherein the channel 56 in the guide member 58 has a longitudinal bore 96 which communicates with the pressure medium chamber 54 via a transverse bore 98 close to the spherical head 92. Furthermore, the guide member 58 is prestressed in the direction of the surface F to be machined by means of a helical pressure spring 100, which in FIG. 1 is accommodated below the guide member 58 in the receiving bore 90 and is supported on a grub screw 102. Finally, the grub screw 102 is screwed into an internally threaded section 104 of the receiving bore 90 in the base body 44 and is provided with a through-bore 106 for the pressure medium.

It can be seen that the receiving section 50 of the articulated part 48 is supported by means of the guide member 58 in the transverse direction with respect to the base body 44. At the same time, the guide member 58 can follow the receiving section 50 in the axial direction, and vice versa, when the pressure medium chamber 54 is acted upon by the pressure medium via the channel 56 and the receiving section 50 is pushed in the direction of the base body 44 counter to the force of the helical pressure spring 100 as a result of external forces. Moreover, on account of the articulated connection to the guide member 58, the receiving section 50 of the articulated part 48 can tilt on the spherical head 92 of the guide member 58, wherein the bellows section 52 of the articulated part 48 is correspondingly deformed.

In order then to ensure that the polishing disk 10 is securely held on and rotated with the receiving section 50 of the tool 12, structures of complementary shape which engage in one another in a form-fitting manner are formed on the facing surfaces of the receiving section 50 of the articulated part 48 and the support body 14 of the polishing disk 10, that is to say on an upper end face 108 of the receiving section 50 in FIG. 1 and the underside 42 of the support body 14. In the illustrated example of embodiment, these structures are formed by a protrusion 110 on the receiving section 50 of the articulated part 48 and an associated cutout 112 in the support body 14 of the polishing disk 10.

As shown in FIGS. 1 and 3, both the protrusion 110 on the receiving section 50 and the cutout 112 in the support body 14 have the shape of a truncated pyramid which has a rectangular, non-square base with a pair of long sides 114 and a pair of short sides 116. If the support surface 38 on the support body 14 is preshaped in a toric manner, with a base axis BA and a cylinder axis ZA (see FIG. 3), the truncated pyramid-shaped cutout 112 in the support body 14 is oriented with respect to the support surface 38 in such a way that the pair of long sides 114 run parallel to the base axis BA, which increases the tilting stability of the polishing disk 10 during the machining operation. A high tilting stability of the polishing disk 10 is also assisted by the fact that the ball joint formed by the undercut receiving chamber 88 in the receiving section 50 of the articulated part 48 and the spherical head 92 of the guide member 58 is at least partially located in the region of the protrusion 110, as a result of which the point about which the receiving section 50 can tilt is relatively close to the site of machining engagement between the polishing disk 10 and the spectacle lens L.

During the fine machining of the optically active surface F of the spectacle lens L that is to be machined, which takes place in a manner known per se by means of loose grain which is supplied to the site of engagement between polishing disk 10 and spectacle lens L by means of a suitable fluid and namely both radially from outside by means of the flexibly adjustable tubes (not shown) mentioned in the introduction and radially from inside via the foam layer 16, the cutout 30 in the foam layer 16 and the at least one opening 20 in the polishing film 18, the tool 12 and the spectacle lens L are driven essentially synchronously, that is to say in the same direction and essentially at the same rotary speed, likewise in a manner known per se. The tool 12 and the spectacle lens L are at the same time pivoted relative to one another, so that the region of engagement between polishing disk 10 and spectacle lens L changes continuously. These fine machining methods, in which, for example in the case of machining free-form surfaces, the pivoting movement takes place at a fixed setting about the centre point of a "best fit radius", that is to say an approximate center point of the surface F of the spectacle lens L that is to be machined, or else the relative movement between tool 10 and spectacle lens L is produced by a path-controlled process in two CNC linear axes and one CNC pivot axis, have long been known to the person skilled in the art and will therefore not be described in any more detail at this point.

As a result of the relative movement of tool 12 and spectacle lens L, the foam layer 16 of the polishing disk 10, as already mentioned above, undergoes a flexing movement, that is to say the foam layer 16 is simultaneously pressed together at one point and released at a different point, as a result of which the liquid polishing agent migrates in the foam layer 16 and is displaced from one region to another region of the foam layer 16 as occurs when a sponge is squeezed. In the process, as shown in FIG. 1 by arrows in the foam layer 16, excess polishing agent is displaced both radially outwards and radially inwards, from where it can wet the surface F of the spectacle lens L to be machined via the opening 20 in the polishing film 18. Pressure is thus released—radially outwards or radially inwards—and this prevents any tearing of the pores in the foam layer 16 and any detachment of the (adhesive) connection between the foam layer 16 and the polishing film 18 or between the foam layer 16 and the support surface 38 of the support body 14.

Figure 4:
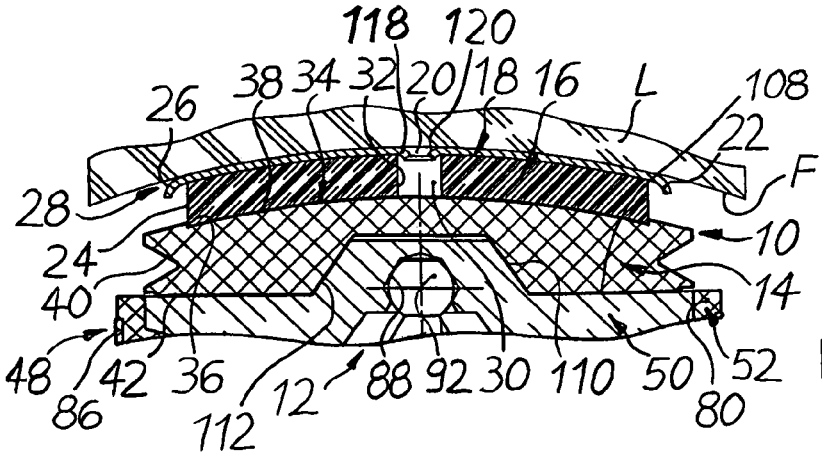
FIG. 4 shows, on an enlarged scale compared to reality, a broken-off view in longitudinal section of a tool for the fine machining of optically active surfaces on spectacle lenses, on which a polishing disk according to a second example of embodiment of the invention is releasably held, said polishing disk being in machining engagement with a surface to be machined.
Figure 5:
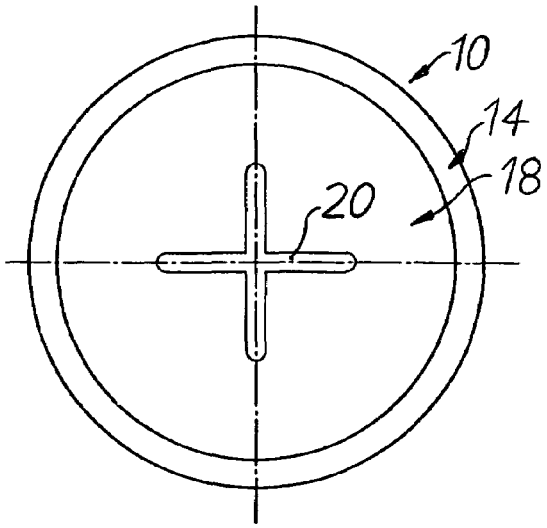
FIGS. 5 to 9 show, on the scale of FIG. 2, plan views of polishing disks according to the invention as shown in FIGS. 1, 2 and 4 which have been removed from the tool, which polishing disks differ in terms of the shape and number of openings in an upper polishing film of the polishing disk.
Figure 6:
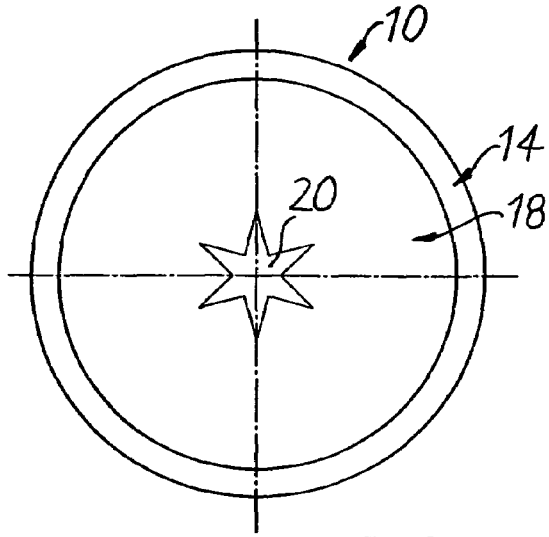
Figure 7:
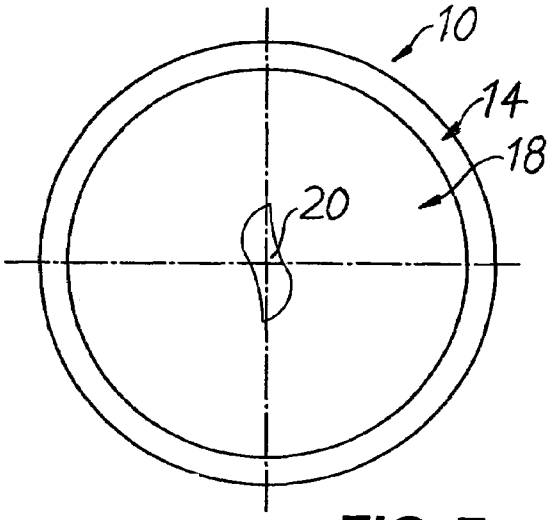
Figure 8:
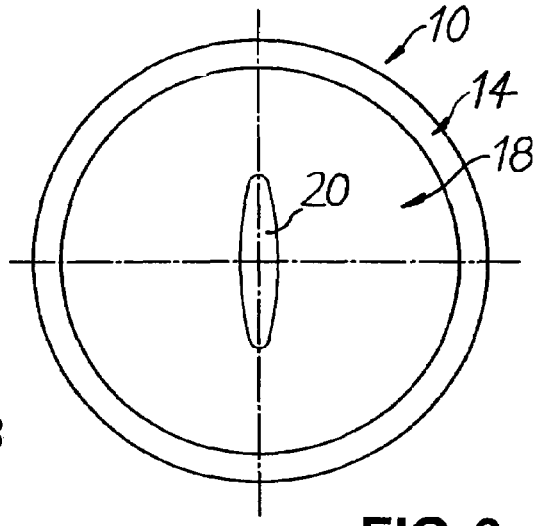
Figure 9:
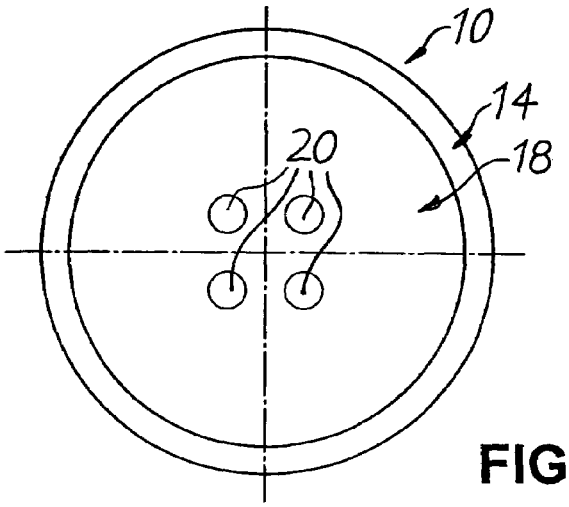

FIG. 4 shows a second example of embodiment of a polishing disk 10, which is mounted on a tool 12 for the fine machining of optically active surfaces F on spectacle lenses L in particular. Since said tool does not differ from the tool 12 shown in FIG. 1, the drawing has been broken off at the bottom. The polishing disk 10 according to the second example of embodiment differs from the polishing disk 10 according to the first example of embodiment only in that the polishing film 18 protrudes radially inwards with an inner edge region 118 beyond the outer peripheral face 32 of the cutout 30 in the foam layer 16. In this case, too, a natural radius of an "edge rounding" is produced at 120, which does not leave behind any undesirable traces of machining during the machining of the optically active surface F.

Finally, FIGS. 5 to 9 show that the opening 20/openings 20 in a central region of the polishing film 18 of the polishing disk 10 may have a different position, size, shape and/or number depending on the respective machining requirements, for example depending on the polishing pressure, the size and/or position of the surface area on the surface F that is to be machined, which is constantly covered by the polishing disk 10 during the machining operation. Shown by way of example are a cross-shaped (FIG. 5), star-shaped (FIG. 6), curved or S-shaped (FIG. 7) and elongate or elliptical (FIG. 8) opening 20 in the polishing film 18 and also a number of openings 20 (FIG. 9) which in terms of their shape and distribution are similar to the attachment holes on a button.

Disclosed is a polishing disk for a tool for the fine machining of optically active surfaces on spectacle lenses in particular, which comprises a support body, to which a foam layer is attached, wherein a polishing film bears against said foam layer. According to the invention, the polishing film is provided with at least one opening in a central region. During machining, the opening ensures pressure equalization and makes liquid polishing agent available from inside the foam layer, as a result of which better rinsing and cooling of otherwise disadvantaged regions of the polishing disk is achieved. As a result, a polishing disk of simple and cost-effective design is proposed, which is much more durable than the prior art while achieving high surface qualities.

We claim:

1. A polishing disk for a tool for the fine machining of optically active surfaces on lenses, the polishing disk comprising a support body, a foam layer attached to said support body, and a polishing film bearing against said foam layer, said polishing film being provided with at least one opening in a central region, wherein a cutout in the foam layer adjoins the at least one opening in the polishing film in the direction of the support body, and wherein the polishing film protrudes inwards beyond an outer periphery of the cutout in the foam layer.

2. A polishing disk according to claim 1, wherein the at least one opening in the polishing film is round.

3. A polishing disk according to claim 1, wherein the at least one opening in the polishing film covers a surface area of 0.25 to 2% of the overall front face of the polishing film.

4. A polishing disk according to claim 1, wherein the cutout extends up to the support body.

5. A polishing disk according to claim 1, wherein the polishing film protrudes outwards beyond an outer periphery of the foam layer.

6. A polishing disk according to claim 1, wherein the support body is provided with a depression for orienting the foam layer.

7. A polishing disk according to claim 1, wherein the support body has a support surface, to which the foam layer is attached, wherein the support surface is pre-shaped in accordance with the macro-geometry of the surface to be machined.

8. A polishing disk according to claim 1, wherein the support body is made of a rubber-elastic material with a Shore A hardness in the range of 60 to 80.

9. A tool for the fine machining of optically active surfaces on lenses, comprising a base body which can be fitted on a tool spindle of a machining machine, an articulated part which has a receiving section guided such that it can be tilted and moved longitudinally with respect to the base body, said receiving section being adjoined in the direction of the base body by a bellows section, by means of which the articulated part is fixed to the base body such that it can rotate therewith, a pressure medium chamber which is delimited by the base body and the articulated part and which can be acted upon by a pressure medium, and a polishing disk which is held on the receiving section of the articulated part in a replaceable manner, said polishing disk comprising a support body, a foam layer attached to said support body, and a polishing film bearing against said foam layer, said polishing film being provided with at least one opening in a central region, wherein a cutout in the foam layer adjoins the at least one opening in the polishing film in the direction of the support body, and wherein the polishing film protrudes inwards beyond a outer periphery of the cutout in the foam layer.

10. A tool according to claim 9, wherein structures of complementary shape are formed on the facing surfaces of the receiving section of the articulated part and the support body of the polishing disk, which structures engage in one another in a form-fitting manner in order to ensure that the polishing disk is securely held on and rotated with the receiving section.

11. A tool according to claim 10, wherein the structures of complementary shape are formed by a protrusion on the receiving section and an associated cutout in the support body.

12. A tool according to claim 11, wherein the protrusion on the receiving section and the cutout in the support body have the shape of a truncated pyramid which has a rectangular, non-square base with a pair of long sides and a pair of short sides.

13. A tool according to claim 12, wherein the support body of the polishing disk has a support surface, to which the foam layer is attached, wherein the support surface is pre-shaped in accordance with the macro-geometry of the surface to be machined, namely pre-shaped in a toric manner, with a base axis and a cylinder axis, and wherein the truncated pyramid-shaped cutout in the support body is oriented with respect to the support surface in such a way that the pair of long sides run parallel to the base axis.

* * * * *